US008928216B2

(12) United States Patent
Hayashizaki et al.

(10) Patent No.: US 8,928,216 B2
(45) Date of Patent: Jan. 6, 2015

(54) HIGH-FREQUENCY ACCELERATOR, METHOD FOR MANUFACTURING HIGH-FREQUENCY ACCELERATOR, QUADRUPOLE ACCELERATOR, AND METHOD FOR MANUFACTURING QUADRUPOLE ACCELERATOR

(75) Inventors: Noriyosu Hayashizaki, Tokyo (JP); Toshiyuki Hattori, Tokyo (JP); Takuya Ishibashi, Tokyo (JP); Fujio Naito, Ibaraki (JP); Eiichi Takasaki, Ibaraki (JP); Hideaki Yamauchi, Hiroshima (JP)

(73) Assignees: Tokyo Institute of Technology, Tokyo (JP); Inter-University Research Institute Corporation High Energy Accelerator Research Organization, Ibaraki (JP); Time Corporation, Hiroshima (JP)

( * ) Notice: Subject to any disclaimer, the term of this patent is extended or adjusted under 35 U.S.C. 154(b) by 512 days.

(21) Appl. No.: 13/501,798

(22) PCT Filed: Oct. 14, 2010

(86) PCT No.: PCT/JP2010/068532
§ 371 (c)(1),
(2), (4) Date: Apr. 13, 2012

(87) PCT Pub. No.: WO2011/046229
PCT Pub. Date: Apr. 21, 2011

(65) Prior Publication Data

US 2012/0200217 A1 Aug. 9, 2012

(30) Foreign Application Priority Data

Oct. 15, 2009 (JP) ..... 2009-238242
Oct. 15, 2009 (JP) ..... 2009-238292

(51) Int. Cl.
*F03H 1/00* (2006.01)
*H05H 7/22* (2006.01)
*H05H 9/04* (2006.01)

(52) U.S. Cl.
CPC *H05H 7/22* (2013.01); *H05H 9/045* (2013.01)
USPC ..... 313/359.1; 445/46

(58) Field of Classification Search
CPC ..... H05H 15/00; B23K 20/12; H01R 43/00; H01R 43/02
See application file for complete search history.

(56) References Cited

U.S. PATENT DOCUMENTS 5,430,359 A * 7/1995 Swenson et al. ..... 315/501
6,573,817 B2 6/2003 Gottschalk

FOREIGN PATENT DOCUMENTS

JP 4-92400 A 3/1992
JP 5-62798 A 3/1993

(Continued)

OTHER PUBLICATIONS

International Search Report of PCT/JP2010/068532 (Dec. 28, 2010).

*Primary Examiner* — Andrew Coughlin
(74) *Attorney, Agent, or Firm* — Millen, White, Zelano & Branigan, P.C.

(57) ABSTRACT

A method of production of a radio frequency accelerator which has a tubular part 1 which forms an acceleration cavity, including a temporary assembly step of making a plurality of component members 11 to 14 which have shapes obtained by splitting the tubular part 1 mate with each other to temporarily assemble them into the shape of the tubular part 10 and a welding step of welding the plurality of component members 11 to 14 together. The temporary assembly step includes a step of placing, inside of the tubular part 1, support members 21 for contacting the inside surface of the tubular part 1 and supporting the tubular part 1 from the inside, and the welding step includes a step of welding the plurality of component members 11 to 14 along the butt lines 51 by friction stir welding.

12 Claims, 12 Drawing Sheets

(56) References Cited

FOREIGN PATENT DOCUMENTS

| | | | |
|---|---|---|---|
| JP | 5-182794 | A | 7/1993 |
| JP | 5-251200 | A | 9/1993 |
| JP | 7-302700 | A | 11/1995 |
| JP | 2001-267120 | A | 9/2001 |
| JP | 2003-7500 | A | 1/2003 |
| JP | 2004-122221 | A | 4/2004 |
| JP | 2005-259415 | A | 9/2005 |
| JP | 2007-287538 | A | 11/2007 |

* cited by examiner

HIGH-FREQUENCY ACCELERATOR, METHOD FOR MANUFACTURING HIGH-FREQUENCY ACCELERATOR, QUADRUPOLE ACCELERATOR, AND METHOD FOR MANUFACTURING QUADRUPOLE ACCELERATOR

TECHNICAL FIELD

The present invention relates to a radio frequency accelerator, a method of production of a radio frequency accelerator, a radio frequency quadrupole accelerator, and a method of production of a radio frequency quadrupole accelerator.

BACKGROUND ART

Known in the art is a radio frequency accelerator for accelerating ions, electrons, or other charged particles. A radio frequency accelerator is provided inside it with an acceleration cavity for accelerating charged particles. The acceleration cavity forms a resonance circuit and has a unique resonance frequency. By supplying radio frequency power in accordance with this resonance frequency from the outside, a radio frequency electric field is excited inside of the acceleration cavity. A radio frequency accelerator can accelerate charged particles up to a desired energy by injecting charged particles at a predetermined timing in the state where the radio frequency electric field is excited.

Radio frequency accelerators are classified by the shape of the path of the charged particles into linear accelerators (linacs) and circular accelerators. Linear accelerator is accelerator with straight paths of the charged particle beam, while circular accelerators are accelerators with curved paths of the charged particle beam. Linear accelerators include, for example, radio frequency quadrupole accelerators, drift tube accelerators, etc.

A radio frequency quadrupole accelerator is provided with four electrodes. The four electrodes form two mutually facing pairs. At the tips of the electrodes, wave shapes suitable for acceleration of a beam are formed in the direction of the acceleration beam axis. In the space surrounded by the four electrodes, an electric field is formed for accelerating and focusing a beam. By injecting charged particles into this space, the charged particles are accelerated.

Japanese Patent Publication (A) No. 5-62798 discloses an external resonance type quadrupole particle accelerator which is provided with an accelerator tube which has electrodes forming the quadrupole structure inside of it and a radio frequency resonance circuit which supplies a resonance voltage to the electrodes. This publication discloses the radio frequency resonance circuit being comprised of a capacitor and two coil conductors serving as an inductance member and the inductance member being arranged in series between the capacitor and the accelerator. According to this accelerator, the resonance frequency can be made to change over a broad range and, further, the quality factor can be raised.

CITATIONS LIST

Patent Literature

PLT 1: Japanese Patent Publication (A) No. 5-62798

SUMMARY OF INVENTION

Technical Problem

The indicators which show the electrical performance of an accelerator include the "quality factor". For example, the indicators which shown the electrical performance of a radio frequency quadrupole accelerator also include the quality factor. The quality factor is proportional to the value of the energy which is stored inside of the cavity at the time of operation of the accelerator divided by the power loss. The larger the quality factor, the longer the operating time per unit energy and the better the operating efficiency.

When a radio frequency power is supplied to a radio frequency accelerator from the outside of the acceleration cavity, an accelerating electric field is excited inside of the acceleration cavity and radio frequency current flows through the inside surface of the acceleration cavity. The acceleration cavity has an electrical resistance based on the shape, material, etc. Power is consumed in accordance with the magnitude of this electrical resistance. If the electrical resistance is large, the power consumption becomes larger and the quality factor becomes lower. The electrical resistance changes due to the surface roughness at the inside surface of the acceleration cavity as well and, as a result, the quality factor changes. The smaller the surface roughness of the inside surface of acceleration cavity, the higher the quality factor.

In the method of production of a radio frequency accelerator of the prior art, a plurality of component members are formed in advance and then the plurality of component members are joined together to form an acceleration cavity. In the step of forming the plurality of component members, it is possible to manufacture component members which are high in dimensional precision and further are small in surface roughness. For example, by cutting with a high precision, it is possible to manufacture component members with a high dimensional precision. Further, it is possible to grind or polish the surfaces of the component members in various ways so as to reduce the surface roughness.

On the other hand, in the step of assembling the acceleration cavity, brazing or electron beam welding etc. were used to join the plurality of component members. As a result, depending on the work method, the surface conditions of the joints deteriorated and the quality factor of the accelerator became smaller. To raise the quality factor, it was necessary to perform grinding work or polishing work after assembling the acceleration cavity.

Further, as explained above, an acceleration cavity has a unique resonance frequency. The resonance frequency depends on the shape of the acceleration cavity. The resonance frequency greatly depends on the shape in the extent that the resonance frequency is affected by the heat expansion or heat contraction in micron units due to temperature changes of the acceleration cavity. For this reason, the resonance frequency greatly depends on the precision of fabrication. In the manufacture of an accelerator cavity, preferably the cavity is produced with dimensions matching the design values.

In this regard, in a method of production of a conventional radio frequency accelerator, there was sometimes the problem that dimensional changes occurred in the step of joining the component members. For example, when joining component members together by brazing, the component members were temporarily assembled, then brazing filler metals were placed at the joining parts. Next, the temporarily assembled component members were placed inside a high temperature furnace to make the brazing filler metals melt. At this time, the component members were heated overall and sometimes dimensional changes occurred due to the temperature changes. That is, the component members rose in temperature overall, so heat deformation occurred. As a result, sometimes the resonance frequency ended up greatly deviating from the design value.

In this way, in a conventional radio frequency accelerator and method of production of a radio frequency accelerator, the electrical performance tended to end up deteriorating from the design values. Special work was required for improving the electrical performance. Further, individual differences arose in the electrical performance, so even with the same type of accelerator, processing was necessary while considering the individual differences.

The present invention provides a radio frequency accelerator and a radio frequency quadrupole accelerator which are excellent in electrical performance and easy to manufacture and a method of production of the radio frequency accelerator and method of production of the radio frequency quadrupole accelerator.

Solution to Problem

A method of production of a radio frequency accelerator of the present invention provides a method of production of a radio frequency accelerator which has a tubular part which forms an acceleration cavity and which has electrodes arranged inside of the tubular part, including a preparation step of preparing a plurality of component members which have shapes obtained by splitting the tubular part, a temporary assembly step of making the plurality of component members mate with each other to temporarily assemble them into the shape of the tubular part, a step of fastening a temporarily assembled tubular part by pressing it from the outer side, and a welding step of welding the plurality of component members together. The temporary assembly step includes a step of placing, inside of the tubular part, support members for contacting the inside surface of the tubular part and supporting the tubular part from the inside, and the welding step includes a step of welding the plurality of component members along the butt lines by friction stir welding.

In the present invention, preferably the plurality of component members are formed with cutaway parts at the regions for friction stir welding, and the method includes a step of attaching reinforcing members which have shapes which engage with the cutaway parts after the welding step.

In the present invention, the method may be a method of production of an accelerator which is provided with four electrodes which stick out from the tubular part toward the acceleration beam axis of the charged particles, where the plurality of component members have shapes obtained by splitting the tubular part near the bottom parts of the electrodes and where the temporary assembly step includes a step of arranging support members which contact butt lines of the plurality of component members and extend along the acceleration beam axis.

In the present invention, preferably the preparation step prepares component members comprised of members which form the tubular part and electrodes which are formed seamlessly.

The radio frequency accelerator of the present invention is provided with a tubular part which forms an acceleration cavity and which includes a plurality of component members, at least one component member among the plurality of component members includes an electrode, the plurality of component members are welded with each other through joints which are formed by friction stir welding, the joints are formed with stripe-shaped weld marks at outer surfaces, and a surface roughness of the inner surfaces is smaller than a surface roughness at the outer surfaces.

In the present invention, preferably the tubular part has cutaway parts which are formed at regions of the joints of the friction stir welding and the radio frequency accelerator is further provided with reinforcing members which are engaged with the cutaway parts to be fastened to the component members.

The radio frequency quadrupole accelerator of the present invention is provided with a center member which includes a center outer frame part, a first electrode which sticks out from the center outer frame part toward the inside, and a second electrode which sticks out from the center outer frame part toward the inside, a first side member which includes a first side outer frame part, a first wall part which extends from the first side outer frame part toward the outside and which has the shape of part of an acceleration cavity, and a third electrode which sticks out from the first wall part toward the inside and which is arranged at one side of the center member, and a second side member which includes a second side outer frame part, a second wall part which extends from the second side outer frame part toward the outside and which has the shape of part of an acceleration cavity, and a fourth electrode which sticks out from the second wall part toward the inside and which is arranged at the other side of the center member. The center member, the first side member, and the second side member are respectively formed seamlessly from single members. The center member, the first side member, and the second side member are configured so that the center outer frame part, the first side outer frame part, and the second side outer frame part are fastened by fastening members.

In the present invention, preferably the center member, the first side member, and the second side member are fastened with each other through conductive members.

A method of production of a radio frequency quadrupole accelerator of the present invention includes a member preparation step which prepares a center member which includes a center outer frame part, a first electrode which sticks out from the center outer frame part and a second electrode which sticks out from the center outer frame part, a first side member which includes a first side outer frame part, a first wall part which has the shape of part of an acceleration cavity, and a third electrode which sticks out from the first wall part, and a second side member which includes a second side outer frame part, a second wall part which has the shape of part of an acceleration cavity, and a fourth electrode which sticks out from the second wall part, and an assembly step of arranging the first side member and the second side member at the both sides of the center member and fastening the center outer frame part, first side outer frame part, and second side outer frame part with each other by fastening members. The member preparation step includes a step of respectively forming the center member, first side member, and second side member seamlessly from single members.

In the present invention, preferably the member preparation step includes a step of forming reference marks at an outer surface of the center member and a step of forming positioning marks at the outer surface of the first side member and the outer surface of the second side member, and the assembly step includes a step of aligning the reference marks and the positioning marks to position the members with each other.

In the present invention, preferably the member preparation step includes a step of forming first engagement parts at the center member and a step of forming second engagement parts at the first side member and second side member, and the assembly step includes a step of making the first engagement parts and the second engagement parts engage with each other so as to position the members with each other.

In the present invention, preferably the member preparation step includes a step of forming first positioning holes at the center member and a step of forming second positioning holes at the first side member and the second side member, and the assembly step includes a step of inserting positioning pins in the first positioning holes and the second positioning holes so as to position the members with each other.

Advantageous Effects of Invention

According to the present invention, it is possible to provide a radio frequency accelerator and a radio frequency quadrupole accelerator which are excellent in electrical performance and easy to manufacture and a method of production of the radio frequency accelerator and a method of production of the radio frequency quadrupole accelerator.

DESCRIPTION OF EMBODIMENTS

Embodiment 1

Referring to FIG. 1 to FIG. 11, a radio frequency accelerator and a method of production of a radio frequency accelerator in Embodiment 1 will be explained. In the present embodiment, a linear accelerator is taken up as an example for explanation.

Figure 1:
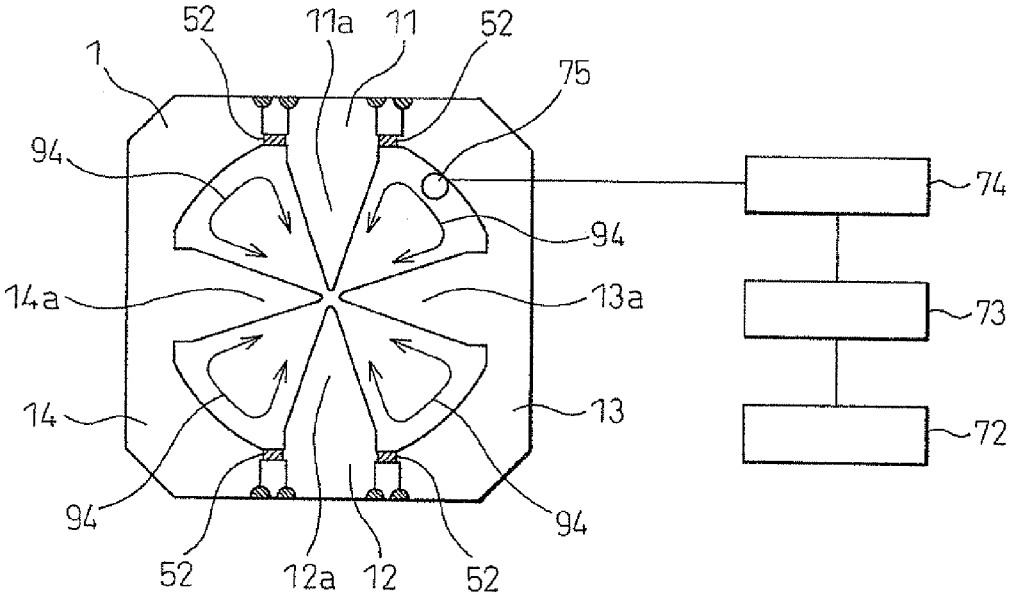
FIG. 1 is a schematic view of a first radio frequency accelerator in Embodiment 1.

FIG. 1 is a schematic view of a first radio frequency accelerator in the present embodiment. The first radio frequency accelerator is a quadrupole type (RFQ) accelerator. The radio frequency accelerator is provided with a tubular part 1 which forms an acceleration cavity and is formed in a tubular shape. Inside of the tubular part 1, electrodes called "vanes" are arranged. These electrodes are electrically connected to the tubular part 1.

The first radio frequency accelerator is provided with a first electrode 11*a*, second electrode 12*a*, third electrode 13*a*, and fourth electrode 14*a*. The four electrodes 11*a*, 12*a*, 13*a*, and 14*a* in the present embodiment are seamlessly formed with the members forming the tubular part 1. These electrodes 11*a*, 12*a*, 13*a*, and 14*a* are formed into triangular prism shapes. These electrodes 11*a*, 12*a*, 13*a*, 14*a* are formed to extend along the acceleration beam axis of the charged particles. These electrodes 11*a*, 12*a*, 13*a*, and 14*a* are formed so that the vertexes of the triangular shapes of the cross-sectional shapes face the acceleration beam axis of the charged particles. The tip parts of the electrodes 11*a*, 12*a*, 13*a*, 14*a* facing the acceleration beam axis are formed in wave shapes so as to form an electrical field which accelerates and focuses charged particles in the direction of the acceleration beam axis. Further, the end faces at the both sides of the electrodes 11*a*, 12*a*, 13*a*, and 14*a* are more separated toward the inside side of the acceleration cavity than the end faces of the tubular part 1. Cutaway parts may also be formed near the bottom parts of the both ends of these electrodes.

The radio frequency accelerator in the present embodiment is provided with a power supply device for supplying radio frequency power. The power supply device includes a radio frequency signal generator 72. The radio frequency signal generator 72 is connected to a preamplifier 73 and a main amplifier 74. The radio frequency power which is oscillated by the radio frequency signal generator 72 is amplified by the preamplifier 73 and main amplifier 74. The radio frequency power which is output from the main amplifier 74 is supplied through a coupler 75 to the acceleration cavity. The power supply device is not limited to this. It is possible to employ any device which can supply the acceleration cavity with radio frequency power.

The acceleration cavity has a floating capacitance and floating inductance which depend on the shapes of the tubular part 1 and the electrodes 11*a*, 12*a*, 13*a*, and 14*a*. These floating capacitance and floating inductance form part of the electrical circuit. Due to the acceleration cavity being supplied with radio frequency power, an accelerating electrical field is excited. When forming an electromagnetic field of the TE210 mode or TE211 mode suitable for a radio frequency quadrupole accelerator, the potentials of the first electrode 11*a*, second electrode 12*a*, third electrode 13*a*, and fourth electrode 14*a* become the same. Further, the electrode pair of the mutually facing first electrode 11*a* and second electrode 12*a* and the electrode pair of the mutually facing third electrode 13*a* and fourth electrode 14*a* have opposite polarities (plus or minus). The acceleration beam axis is arranged in the space surrounded by the four electrodes. The charged particles move while being accelerated along the acceleration beam axis.

Figure 2:
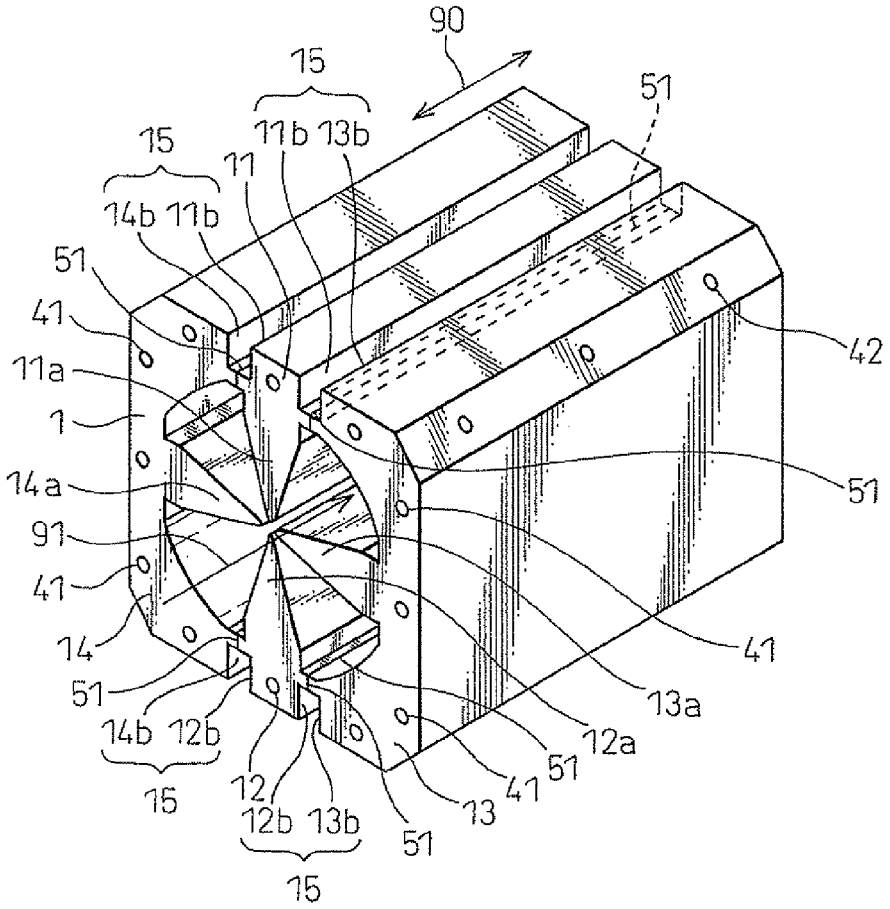
FIG. 2 is a schematic perspective view which explains a first step of a method of production of the first radio frequency accelerator in Embodiment 1.

FIG. 2 is a schematic perspective view which explains a first step of a method of production of a first radio frequency accelerator in the present embodiment. In the method of production of a radio frequency accelerator in the present embodiment, a plurality of component members are welded to form an acceleration cavity. The component member in the present embodiment has a shape obtained by splitting the tubular part 1. The direction which is shown by the arrow 90 is the direction which extends along the acceleration beam axis.

In the present embodiment, a first component member 11 which has a first electrode 11*a*, a second component member 12 which has a second electrode 12*a*, a third component member 13 which has a third electrode 13*a*, and a fourth component member 14 which has a fourth electrode 14*a* are prepared in a preparation step. The plurality of component members 11 to 14 in the present embodiment are formed by cutting an aluminum block. The component members 11 to 14 in the present embodiment are comprised of the members forming the tubular part and the electrodes formed seamlessly. Furthermore, in the present embodiment, the surfaces of the component members 11 to 14 are polished. In the manufacture of the component members 11 to 14, an aluminum block may be cut to form a component member comprised of the component member 11 and component member 12 joined together. Further, precision cutting may be performed so as not to polish the surfaces of the component members.

Next, the plurality of component members 11 to 14 are temporarily assembled into the shape of the tubular part 1 in a temporary assembly step. The first component member 11, second component member 12, third component member 13, and fourth component member 14 are mated together whereby butt lines 51 are formed. In the present embodiment, the tubular part 1 is split near the bottom part of the first electrode 11*a*. Further, the tubular part 1 is split near the bottom part of the second electrode 12*a*. In the present embodiment, the tubular part 1 is split so that the butt lines 51 become substantially parallel to the direction which extends along the acceleration beam axis. These component members are welded at the butt lines 51 by friction stir welding in the later welding step.

The plurality of component members 11 to 14 in the present embodiment are formed with cutaway parts at the regions for friction stir welding in the later welding step. That is, the end parts to become the butt lines 51 are formed with cutaway parts. The first component member 11 is formed with a cutaway part 11*b*, the second component member 12 is formed with a cutaway part 12*b*, the third component member 13 is formed with a cutaway part 13*b*, and the fourth component members 14 is formed with a cutaway part 14*b*. These cutaway parts 11*b*, 12*b*, 13*b*, 14*b* are made to mutually face each other, whereby grooved parts 15 are formed. In this way, the regions for friction stir welding along the butt lines 51 are formed with grooved parts 15. Note that, the cutaway parts 11*b*, 12*b*, 13*b*, and 14*b* may be formed so that the mutually facing cutaway parts engage.

The end faces of the tubular part 1 are formed with a plurality of threaded holes 41 for attaching end plates. These component members 11 to 14 are formed with through holes 42 for passing bolts which fasten the support members.

In the temporary assembly step, support members are arranged inside the tubular part 1 for supporting the tubular part 1 from the inside. In the present embodiment, support members which contact the inside surface of the tubular part 1 are arranged in the spaces between the electrodes 11*a*, 12*a*, 13*a*, and 14*a*.

Figure 3:
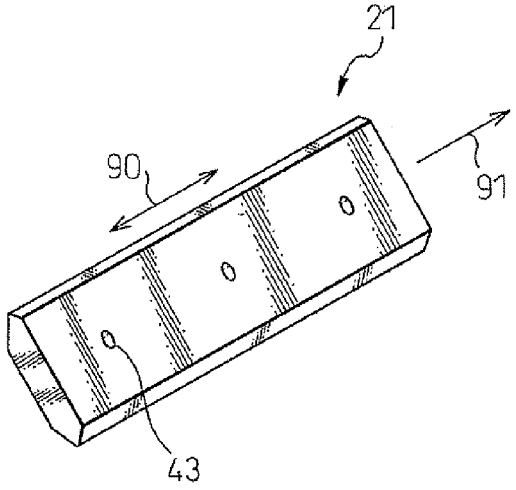
FIG. 3 is a schematic perspective view of a support member which is used for the method of production of the first radio frequency accelerator in Embodiment 1.

FIG. 3 is a schematic perspective view of a support member which is used for the method of production of a first radio frequency accelerator of the present embodiment. The support member 21 in the present embodiment is formed so as to extend in the direction of the acceleration beam axis which is shown by the arrow 90 from near one end face of the tubular part 1 to near the other end face. The support member 21 is formed with threaded holes 43 into which bolts are inserted for fastening with a component member. The support member 21 is preferably formed by a material with a high stiffness. The support member 21 can be formed, for example, by stainless steel.

Referring to FIG. 2 and FIG. 3, in the present embodiment, as shown by the arrow 91, a support member 21 is inserted into the space between the first electrode 11*a* and third electrode 13*a*. Further, similarly, corresponding support members are also inserted into the spaces between the other electrodes. In the present embodiment, the plurality of component members are mated to form the tubular part, then the support members are inserted, but the invention is not limited to this. It is also possible to arrange the support members at the inside when mating the component members. Through holes 42 which are formed at the component members 11 to 14 are formed so as to correspond to the threaded holes 43 which are formed at the support members 21.

Figure 4:
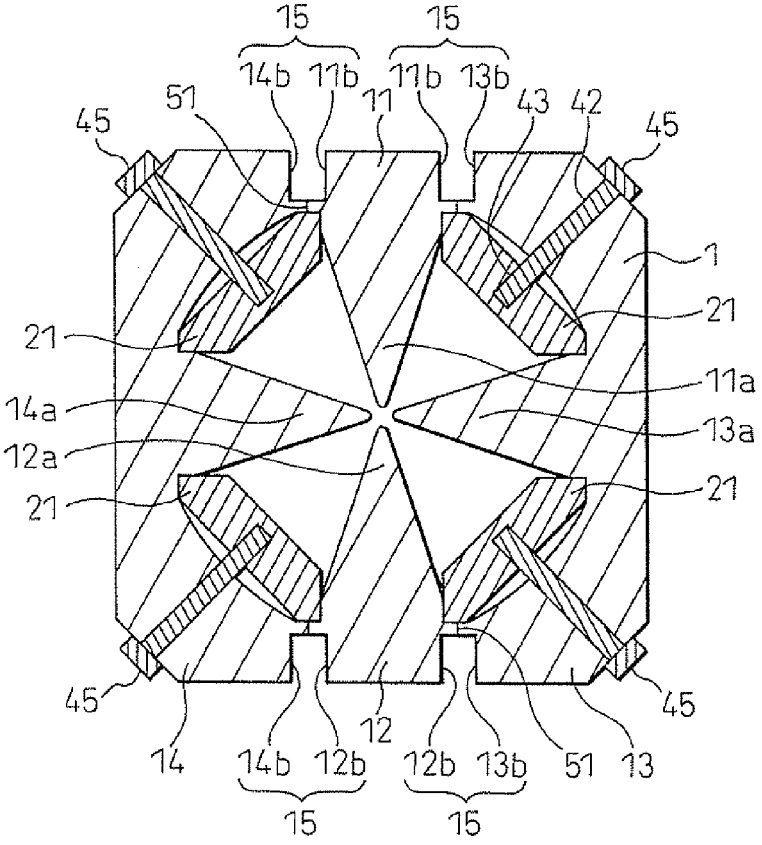
FIG. 4 is a schematic cross-sectional view which explains a second step of the method of production of the first radio frequency accelerator in Embodiment 1.

FIG. 4 is a schematic cross-sectional view which explains a second step of the method of production of the first radio frequency accelerator in the present embodiment. FIG. 4 is a schematic cross-sectional view of the time when placing support members in the spaces between the electrodes. The support members 21 in the present embodiment are arranged at positions away from the electrodes 11*a*, 12*a*, 13*a*, and 14*a*. The support members 21 are formed so as to be engaged with parts of the spaces between the electrodes 11*a*, 12*a*, 13*a*, and 14*a*. These support members 21 are formed so as to contact the butt lines 51 at the inside surface of the tubular part 1. That is, the support members 21 are formed so as to support the regions for friction stir welding from inside of the tubular part 1.

After placing the support members 21 between the electrodes, the support members 21 are fastened by bolts 45 to the component members 11 to 14. By fastening the bolts 45, the support members 21 closely contact the inner surface of the tubular part 1. The support members 21 closely contact the inner surface of the region for friction stir welding.

Figure 5:
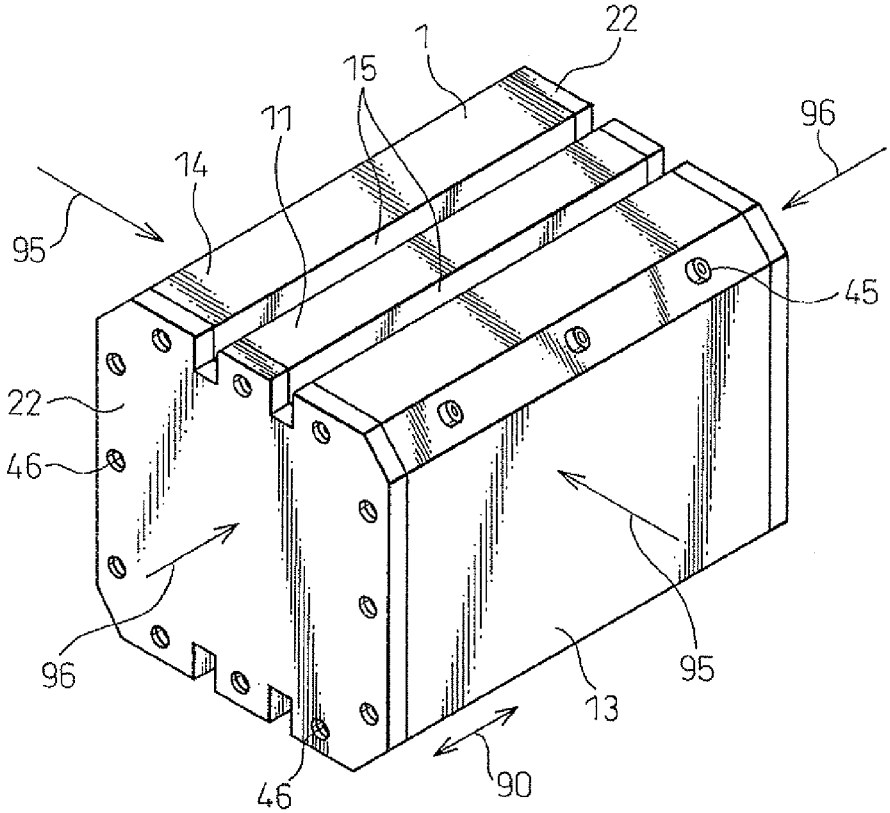
FIG. 5 is a schematic perspective view which explains a third step of the method of production of the first radio frequency accelerator in Embodiment 1.

FIG. 5 is a schematic perspective view which explains a third step of the method of production of the first radio frequency accelerator in the present embodiment. Next, temporary end plates 22 for production use are attached to the end faces of the both sides of the tubular part 1. The temporary end plates 22 are formed so as to be suitable for the shapes of the end faces of the tubular part 1. The temporary end plates 22 are formed with pluralities of holes. The temporary end plates 22 are fastened by bolts 46 to the tubular part 1.

Next, the temporarily assembled tubular part 1 is pressed from the outside. In the present embodiment, a not shown fastening device is used to fasten the tubular part 1. As shown by the arrow 96, the tubular part 1 is pressed from the both sides in the direction of the acceleration beam axis so as to fasten it. Furthermore, as shown by the arrow 95, the tubular part 1 is pressed from the both sides in the direction vertical to the acceleration beam axis for fastening. Referring to FIG. 4, even if pressed from a direction vertical to the acceleration beam axis, the support members 21 can maintain the component members 11 to 14 at predetermined positions against the pressing force.

In the present embodiment, the inside surface of the tubular part is pressed by the support members while the outer surface of the tubular part is pressed by the fastening device. Since the tubular part is fastened from the inside surface and outside surface, it is possible to strongly maintain the shape of the tubular part. It is therefore possible to suppress changes in the dimensions at the next welding step. As a result, the acceleration cavity can be precisely formed.

Next, the plurality of component members are welded with each other by friction stir welding in a welding step. Referring to FIG. 2, these component members 11 to 14 are welded along the butt lines 51.

Figure 6:
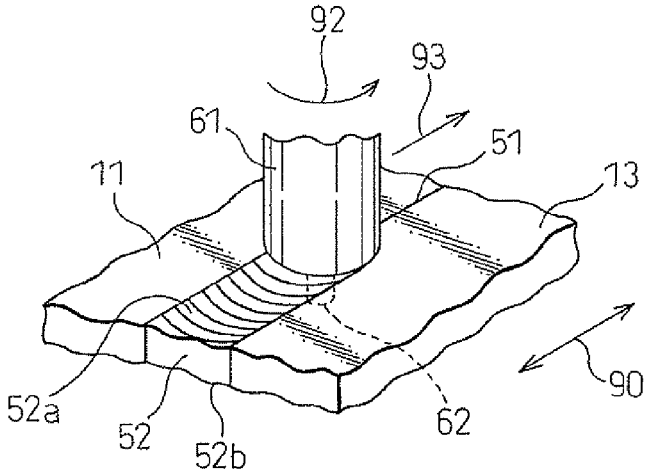
FIG. 6 is a schematic perspective view which explains friction stir welding in Embodiment 1.

FIG. 6 is a schematic perspective view when performing friction stir welding in the present embodiment. FIG. 6 is an enlarged perspective view when welding the first component member 11 and the third component member 13.

The welding device using friction stir welding includes a shoulder 61. The shoulder 61, as shown by the arrow 92, is formed so as to rotate. The welding device includes a pin 62 which sticks out from the shoulder 61. The pin 62 is formed so as to rotate together with the shoulder 61. The welding device, as shown by the arrow 92, turns the shoulder 61 and pin 62 while pressing the pin 62 toward the members to be welded. Due to the heat of friction of the pin 62 and the members to be welded, the members to be welded are softened. The pin 62 is inserted inside of the members to be welded. By rotation of the pin 62, the area around the pin 62 is made to plastically flow. By making the pin 62 move along the welding line, one member is welded with the other member.

In the present embodiment, the pin 62 is pressed on the butt line 51. The pin 62 is pressed from the outside of the tubular part 1. The first component member 11 and the third component member 13 soften. In the present embodiment, the pin 62 moves while maintaining a state where the tip part is buried in the softened part without passing through the first component member 11 and the third component member 13. The mutually welded component members soften from the surface at the side where the pin 62 is inserted up to the surface at the opposite side. That is, they are softened over the entire thickness direction.

In the present embodiment, the friction stir welding is performed in the state with the tip part of the pin buried in the softened part, but the invention is not limited to this. The friction stir welding may also be performed in the state with the tip part of the pin passed slightly through the softened part. That is, if slight, the pin may also pass through. In this way, the friction stir welding may be performed in the state with the tip part of the pin substantially buried in the softened part. When performing friction stir welding in the state where the tip part of the pin slightly passes through the softened part, for example, it is possible to use a support member formed with a part sunken at the surface along the joint. When performing friction stir welding, the tip part of the pin is arranged at the sunken part. Due to this method, it is possible to perform the friction stir welding while avoiding contact between the support member and the pin.

By rotation of the pin 62, as shown by the arrow 93, by moving along the butt line 51, the first component member 11 and the third component member 13 are welded. A joint 52 comprised of the first component member 11 and the third component member 13 welded integrally is formed. By making the pin 62 move from one end part to the other end part of the butt line 51, the first component member 11 and the third component members 13 can be welded. The other component members can also be welded by similar friction stir welding.

Next, the temporary end plates 22 which are attached to the end faces of the tubular part 1 and the support members 21 which were arranged in the spaces between the electrodes 11*a*, 12*a*, 13*a*, and 14*a* are detached. The temporary end plates may be detached or the support members may be detached after the next reinforcing members finish being attached.

Figure 7:
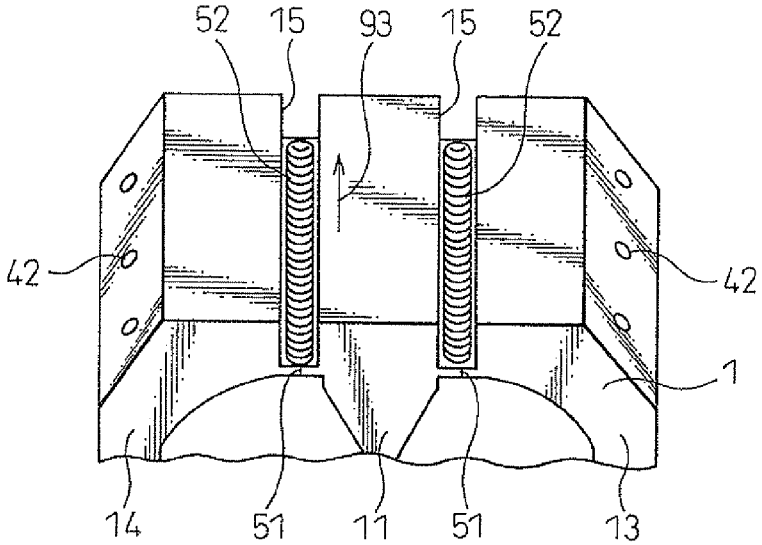
FIG. 7 is a schematic perspective view which explains a fourth step of the method of production of the first radio frequency accelerator in Embodiment 1.

FIG. 7 is a schematic perspective view of a tubular part after friction stir welding. A joint 52 is formed at substantially the entire butt line 51 of the first component member 11 and the third component member 13. Further, a joint 52 is formed at substantially the entire butt line 51 of the first component member 11 and the fourth component member 14. The butt line 51 between the second component member 12 and the third component member 13 and the butt line 51 between the second component member 12 and the fourth component member 14 can similarly be welded by friction stir welding. In this way, the component members 11 to 14 can be welded by friction stir welding.

Note that, in the manufacture of the tubular part, it is also possible to form component members which are longer than the design values in the direction of the acceleration beam axis, weld these component members, then cut the end parts at the both sides in the direction of the acceleration beam axis. By this method, it is possible to manufacture an acceleration cavity which is formed with joints from one end to the other end in the direction of the acceleration beam axis of the tubular part.

Figure 8:
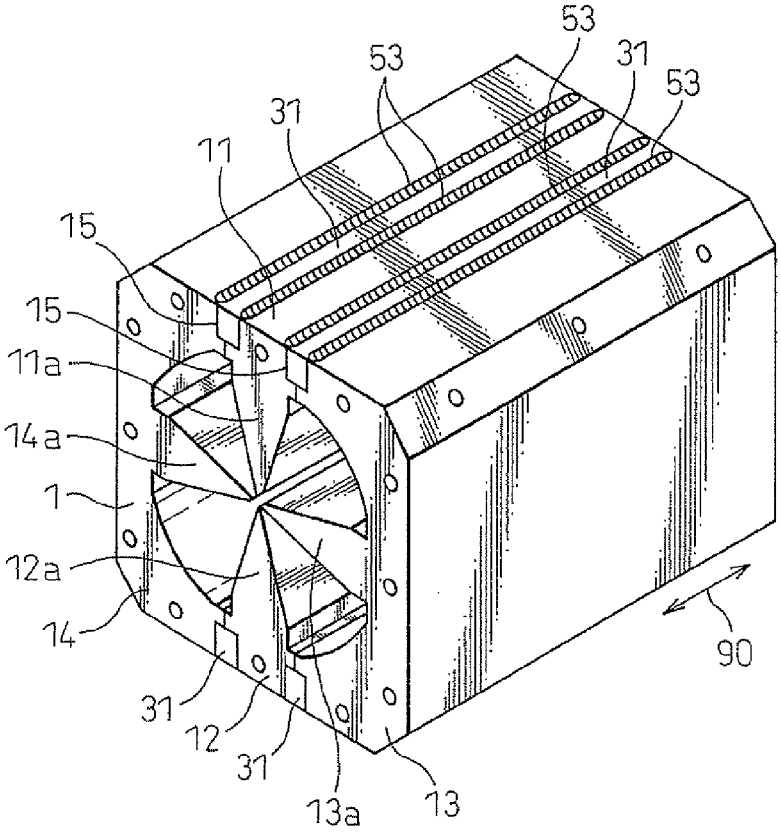
FIG. 8 is a schematic perspective view which explains a fifth step of the method of production of the first radio frequency accelerator in Embodiment 1.
Figure 9:
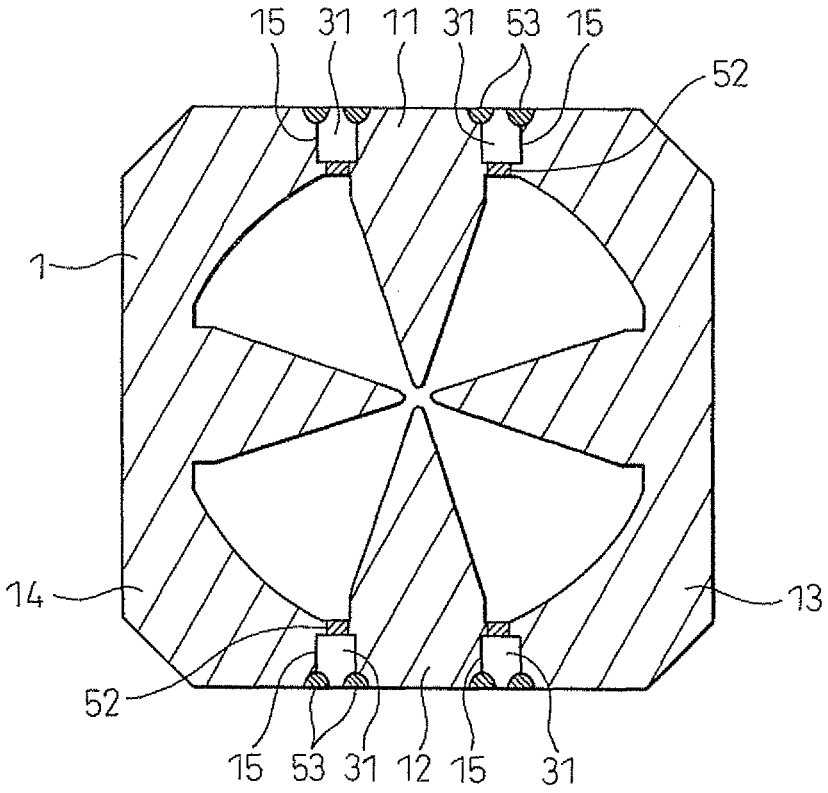
FIG. 9 is a schematic cross-sectional view which explains a fifth step of the method of production of the first radio frequency accelerator in Embodiment 1.

FIG. 8 is a schematic perspective view which explains a fifth step of the method of production of the first radio frequency accelerator in the present embodiment. FIG. 9 is a schematic cross-sectional view which explains a fifth step of the method of production of the first radio frequency accelerator in the present embodiment. FIG. 8 and FIG. 9 are schematic views when attaching reinforcing members to the grooved parts of the tubular part. In the present embodiment, after the welding step, reinforcing members 31 which correspond to the shapes of the grooved parts 15 are placed in the grooved parts 15. The reinforcing members 31 are formed to engage with the grooved parts 15. The grooved parts 15 in the present embodiment are formed to become square in cross-sectional shapes. In the present embodiment, block-shaped reinforcing members 31 are placed in the grooved parts 15. Note that, the cross-sectional shapes of the grooved parts which are employed may be any shapes so long as not obstructing movement of the shoulder of the welding device at the time of friction stir welding.

Next, the reinforcing members 31 are attached to the component members 11 to 14. In the present embodiment, friction stir welding is used to attach the reinforcing members 31. Friction stir welding is performed along the boundary lines of the component members 11 to 14 and the reinforcing members 31 to thereby form the joints 53. The reinforcing members 31 can be fastened to the component members 11 to 14. The method of fastening the reinforcing members is not limited to friction stir welding. Electron beam welding or any other method may also be used.

Further, the shapes of the reinforcing members may be formed so as to reinforce the parts where the thickness is made thinner due to forming cutaway parts of the component members. Alternatively, when the strength of the tubular part is maintained, the reinforcing members need not be arranged. Alternatively, the grooved parts may be used to form flow paths for a coolant. For example, it is possible to arrange reinforcing members at the top faces of the grooved parts to form paths for flowing cooling water of the acceleration cavity.

Next, it is possible to attach end plates formed in advance to the end faces of the tubular part so as to form an acceleration cavity. The end plates may have exhaust pipes which are connected to the vacuum device or inlet pipes or outlet pipes of charged particles attached to them. This acceleration cavity may have a power supply device or vacuum device etc. connected to it for manufacture of the accelerator.

The first radio frequency accelerator of the present invention is comprised of these component members welded by friction stir welding. Referring to FIG. 6, at a joint 52, the surface 52*a* at which the pin 62 of the welding device is inserted is formed with a stripe-shaped weld mark. The weld mark is, for example, formed so as to become a projecting shape at the opposite side to the direction of movement of the pin 62. The surface at the side where the pin 62 is inserted is formed with surface asperity.

In this regard, the surface 52*b* at the opposite side to the side where the pin 62 is inserted becomes smooth without the formation of stripe-shaped weld mark. The surface 52*b* is not formed with surface asperity. The surface roughness becomes smaller than the surface 52*a*. The accelerator in the present embodiment is formed with stripe-shaped weld mark at the outer surface of the tubular part 1, but is formed smooth at the inside surface of the tubular part 1.

Referring to FIG. 1, in the first radio frequency accelerator of the present embodiment, when exciting an electromagnetic field of the TE210 mode or TE211 mode suitable for a radio frequency quadrupole accelerator, the magnitudes of the potentials of the electrodes at any time become equal. The polarities are the same at mutually facing electrodes. The polarities of the potentials of mutually facing electrodes in one direction are opposite to the polarities of the potentials of the mutual facing electrodes in a direction perpendicular to that one direction. By using the power supply device to supply radio frequency power, the potentials of the electrodes change along with time corresponding to a sine wave. For example, when, at one point of time, the potentials of the first electrode 11*a* and the second electrode 12*a* are the maximum value (positive value with maximum magnitude), the potentials of the third electrode 13*a* and the fourth electrode 14*a* become the minimum value (negative value with maximum magnitude). After the elapse of the half period of the resonance frequency, the potentials of the electrodes become the reverse relationship.

Radio frequency current flows through the inside surface of the tubular part 1 due to the skin effect. For this reason, the current, as shown by the arrow 94, flows along the outside surfaces of the electrodes 11*a*, 12*a*, 13*a*, and 14*a* and the inside surface of the tubular part 1. At this time the current flows through the smooth surfaces 52*b* of the joints 52. In the present embodiment, the surface roughness of the surfaces 52*b* of the joints 52 is small, so the power loss can be reduced. For example, even when not polishing the surface after friction stir welding, the power loss at the surfaces 52*b* of the joints 52 can be reduced. As a result, the quality factor of the accelerator can be raised.

In the present embodiment, the surface is not polished after the welding step using friction stir welding, but the invention is not limited to this. The surface may also be polished after the welding step. By this method, it is possible to further improve the quality factor. For example, it is possible to perform electrolytic polishing etc. so as to further reduce the surface roughness. Alternatively, it is also possible to perform plate processing inside surface of the tubular part for improving the conductivity.

Further, in the present embodiment, friction stir welding is used to weld the component members, so the parts which rise in temperature are limited to ones near the joints. That is, the rise in temperature of the component members is limited to local parts. For this reason, for example, it is possible to avoid the component members from being heated overall such as when joining the members by brazing and possible to suppress heat deformation of the component members. Heat deformation includes deformation due to release of internal stress when releasing the fastening of the tubular part by the fastening device for a temporary assembly. In the present embodiment, it is possible to suppress deformation of the tubular part, so it is possible to suppress deviation of the resonance frequency due to deformation. It is therefore possible to produce an accelerator precisely with respect to the design values.

In this way, the radio frequency accelerator in the present embodiment is high in the quality factor, small in deviation of the resonance frequency, and otherwise excellent in electrical performance.

Further, the radio frequency accelerator in the present embodiment has a small surface roughness at the inner surfaces of the joints, so can be easily manufactured even without mechanical finishing after welding the plurality of component members. Alternatively, it is sufficient to perform simple grinding etc. and production is easy. For example, when using electron beam welding to weld the component members, the surface roughness at the penetration bead is large, so further grinding work or polishing work was necessary. In the radio frequency accelerator of the present embodiment, it is possible to produce an acceleration cavity with a small surface roughness of the inside surface even without performing such finishing work.

Further, in the method of production of a radio frequency accelerator in the present embodiment, it is possible to confirm the state of welding in the middle of the welding step. For example, it is possible to find out problems in the middle of the welding step and correct the work etc. As a result, the yield can be improved.

In the method of production of an accelerator in the present embodiment, a support member for supporting the tubular part from the inside is placed inside the temporarily assembled tubular part. By employing this method, when performing the friction stir welding, it is possible to keep the component members from deforming or the component members from deviating from each other. It is therefore possible to manufacture an accelerator with a small manufacturing error. Further, in the method of production in the present embodiment, it is possible to easily produce a radio frequency quadrupole accelerator with a long length in the axial direction along the acceleration beam axis. For example, when using brazing to produce a radio frequency quadrupole accelerator with long axial direction length, it is necessary to place the acceleration cavity inside a high temperature furnace. For this reason, a large size high temperature furnace becomes necessary. However, in the present embodiment, the component members can be joined in the atmosphere and an accelerator which is long in the direction of the acceleration beam axis can be easily produced.

Further, the plurality of component members in the present embodiment have shapes obtained by splitting the tubular part near the bottom parts of the electrodes. Support members which are formed so as to contact the butt lines of the plurality of component members are employed. Due to this method, it is possible to more reliably suppress deformation of the tubular part in friction stir welding. Furthermore, the support members are preferably fastened to the component members. Due to this method, it is possible to more reliably suppress deformation of the tubular part.

The support members in the present embodiment can support the joints against the pressing force of the welding device at the time of friction stir welding. Further, after performing the friction stir welding, the support members may be detached without damaging the inside surface of the tubular part. The support members in the present embodiment are formed in cylindrical shapes which extend in the direction of the acceleration beam axis, but the invention is not limited to this. The support members may be formed so as to enable the tubular part to be supported from the inside.

In the present embodiment, bolts are passed through the through holes which are formed in the component members so as to fasten the support members, but the method of fastening the support members is not limited to this. Any method may be used to fasten the support members to the component members. When forming through holes in the component members, the through holes are preferably small in diameter so that the effect on the resonance frequency of the acceleration cavity becomes small. Alternatively, the through holes which are formed in the component members may be utilized for other Applications as well. For example, the through holes which are formed in the component members may be used as connection ports for connecting a vacuum device.

Further, the component members in the present embodiment are formed with cutaway parts at the regions for performing friction stir welding. After the welding step using friction stir welding, reinforcing members which have shapes which engage with the cutaway parts are attached. Due to this method, it is possible to reduce the thickness of the regions for performing friction stir welding and easily perform friction stir welding. Alternatively, the friction stir welding can be performed in a short time. Furthermore, by fastening the reinforcing members to the component members, deformation of the tubular part can be suppressed during the manufacturing period or the period of operation of the accelerator.

Further, in the present embodiment, in the step of preparing the plurality of component members, component members comprised of the members forming the tubular part and electrodes seamlessly formed are prepared. That is, component members comprised of parts for forming the tubular parts and electrodes made from the same materials are employed. Due to this method, the positional relationship between the tubular part and the electrodes can be maintained precisely at the time of machining. For this reason, the dimensional precision becomes higher and it is possible to provide a radio frequency quadrupole accelerator better in electrical performance.

The radio frequency quadrupole accelerator is not limited to an accelerator which contains four vanes. For example, the present invention may also be applied to a four-rod type of radio frequency quadrupole accelerator in which four electrodes are formed into rod shapes and the rod-shaped electrodes are arranged substantially in parallel in the direction of the acceleration beam axis.

In the first radio frequency accelerator in the present embodiment, electrodes are arranged at all of the component members, but the invention is not limited to this. It is sufficient that at least one of the plurality of component members include an electrode.

Figure 10:
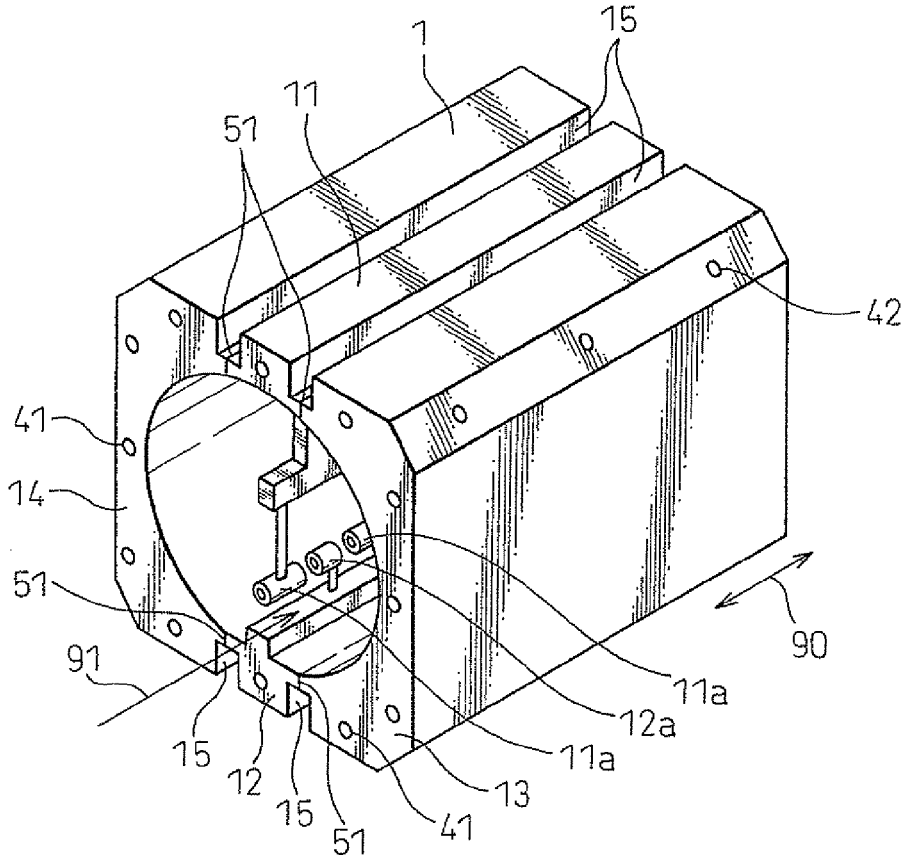
FIG. 10 is a schematic perspective view which explains a method of production of a second radio frequency accelerator of Embodiment 1.

FIG. 10 is a schematic perspective view which explains a method of production of a second radio frequency accelerator in the present embodiment. FIG. 10 is a schematic perspective view of a tubular part of a second radio frequency accelerator in this embodiment. The second radio frequency accelerator is a drift tube accelerator.

In a drift tube accelerator, a tube-shaped first electrode 11*a* and a tube-shaped second electrode 12*a* are arranged along the acceleration beam axis of the charged particles. The charged particles pass through the insides of these electrodes 11*a* and 12*a*. The first electrode 11*a* is formed at a first component member 11. The second electrode 12*a* is formed at a second component member 12. Note that, depending to the radio frequency electromagnetic field mode which is utilized, the electrodes may also be formed at just one of the first component member 11 or second component member 12. Alternatively, when electromagnets etc. for beam focusing are placed inside of the electrodes etc., the electrode parts may be formed to be detachable. The third component member 13 and fourth component member 14 at the second radio frequency accelerator do not have electrodes. The third component members 13 and the fourth component members 14 form the tubular part 1 of the acceleration cavity. The tubular part 1 includes a plurality of component members 11 to 14. These component members are mated at the butt lines 51.

Figure 11:
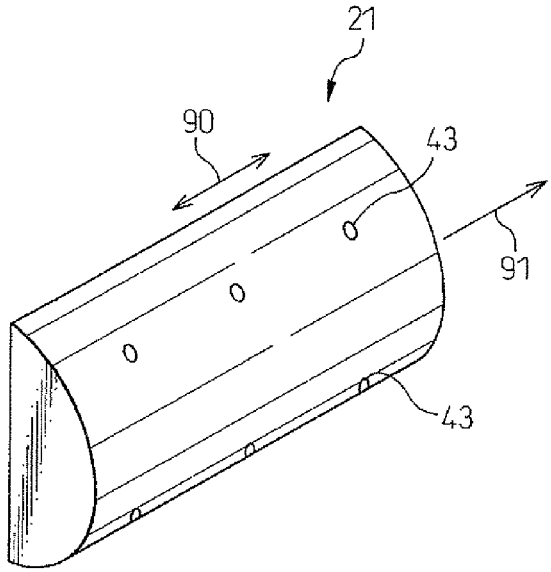
FIG. 11 is a schematic perspective view of a support member which is used for the method of production of the second radio frequency accelerator of Embodiment 1.

FIG. 11 is a schematic perspective view of a support member used for the method of production of the second radio frequency accelerator in the present embodiment. The support member 21 is formed so as to contact the inside surface of the third component member 13 or fourth component member 14. The support member 21 is formed with threaded holes 43 through which bolts are inserted for fastening the support member 21. The support member 21 may have a cross-sectional shape other than a semi-circular shape so long as being a shape which suitably contacts the inner surface of the component members.

Referring to FIG. 10 and FIG. 11, at the temporary assembly step for temporary assembly of the tubular part 1, for example, as shown by the arrow 91, a support member 21 is inserted to the inside of the tubular part 1. By fastening bolts through the through holes 42 to the threaded holes 43, the support member 21 can be fastened to the inside of the tubular part 1. The support member 21 is formed so as to closely contact a butt line 51 from the inside surface of the tubular part 1.

Next, temporary end plates are fastened to the end face of the tubular part 1. After this, the tubular part 1 is fastened to a fastening device. Next, friction stir welding is performed along the butt lines 51 whereby, in the same way as the above radio frequency quadrupole accelerator, a drift tube type accelerator can be produced.

In a drift tube accelerator as well, in the same way as the above radio frequency quadrupole accelerator, friction stir welding is used to weld the component members, whereby it is possible to provide a radio frequency accelerator which is excellent in electrical performance and which is easy to manufacture and to provide a method of production of a radio frequency accelerator.

In the present embodiment, component members which have shapes obtained by splitting the tubular part near the bottom parts of the electrodes are employed, but the invention is not limited to this. It is possible to employ component members which have shapes obtained by splitting the tubular part at any positions. For example, referring to FIG. 9, it is also possible to employ component members which have shapes obtained by splitting the tubular part 1 at substantially intermediate points between mutually adjoining electrodes in the case where the cross-sectional shape of the outer surface of the tubular part 1 is formed to be substantially circular.

Further, in the present embodiment, friction stir welding is performed in a direction substantially parallel to the acceleration beam axis, but the invention is not limited to this. It is possible to perform the friction stir welding in any direction.

The component members in the present embodiment are formed by aluminum, but the invention is not limited to this. The material of the component members used may be any material for which friction stir welding can be performed. For example, in addition to aluminum, copper may be used.

Further, in the present embodiment, among linear accelerators, a radio frequency quadrupole accelerator and a drift tube accelerator were taken up as examples for the explanation, but the invention is not limited to this. It is possible to apply the present invention to any radio frequency accelerator. For example, the invention is not limited to a linear accelerator. The present invention may also be applied to an acceleration cavity for a circular accelerator.

Embodiment 2

Referring to FIG. 12 to FIG. 16, a radio frequency quadrupole accelerator and a method of production of a radio frequency quadrupole accelerator in Embodiment 2 will be explained.

Figure 12:
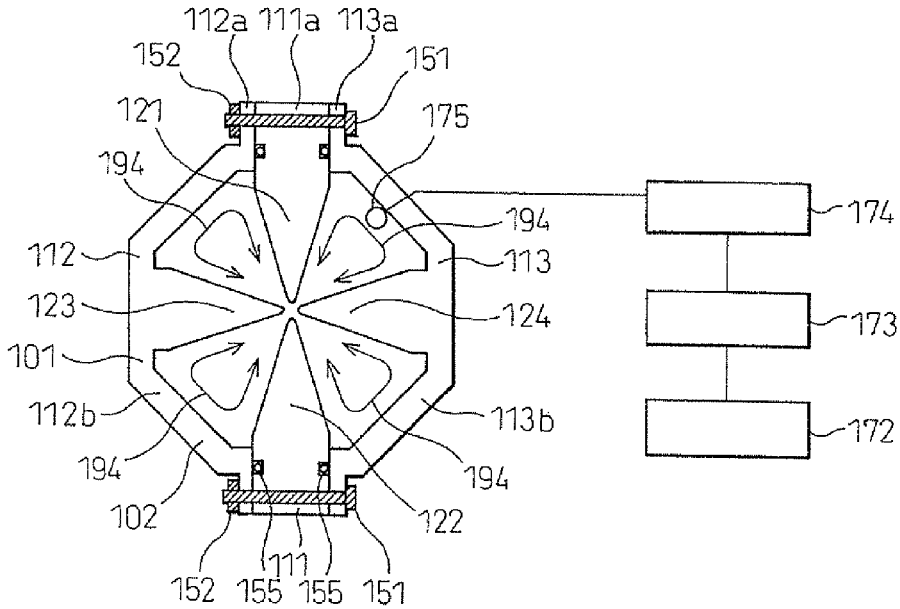
FIG. 12 is a schematic view of a radio frequency quadrupole accelerator in Embodiment 2.

FIG. 12 is a schematic view of the radio frequency quadrupole accelerator in the present embodiment. The radio frequency quadrupole accelerator is provided with an acceleration cavity 101. The acceleration cavity 101 includes a tubular part 102 which is formed into a tubular shape. The acceleration cavity 101 includes electrodes 121 to 124 called "vanes" which stick out from the tubular part 102 toward the inside. These electrodes 121 to 124 are electrically connected to the tubular part 102.

The radio frequency quadrupole accelerator in the present embodiment is provided with a first electrode 121, second electrode 122, third electrode 123, and fourth electrode 124. The four electrodes 121 to 124 in the present embodiment are seamlessly formed with the members which form the tubular part 102. These electrodes 121 to 124 are formed so as to extend along the acceleration beam axis of the charged particles.

The electrodes 121 to 124 in the present embodiment are formed into triangular prism shapes. These electrodes 121 to 124 are formed so that the vertexes of the triangular shapes of the cross-sectional shapes face the acceleration beam axis of the charged particles. The tip parts of the electrodes 121 to 124 facing the acceleration beam axis are formed in wave shapes called "modulation" so as to form an electrical field which accelerates and focuses charged particles in the direction of the acceleration beam axis. The shapes of the electrodes are not limited to this. It is possible to employ any shapes which stick out from the tubular part and whereby the tips of the electrodes approach the acceleration beam axis. For example, the electrodes may also be formed in plate shapes.

The radio frequency quadrupole accelerator in the present embodiment is provided with a power supply device for supplying radio frequency power. The power supply device includes a radio frequency signal generator 172. The radio frequency signal generator 172 is connected to a preamplifier 173 and a main amplifier 174. The radio frequency power which is generated by the radio frequency signal generator 172 is amplified by the preamplifier 173 and main amplifier 174. The radio frequency power which is output from the main amplifier 174 is supplied through a coupler 175 to the acceleration cavity 101. The power supply device is not limited to this. It is possible to employ any device which can supply the acceleration cavity 101 with radio frequency power.

The acceleration cavity 101 has a floating capacitance and floating inductance dependent on the shapes of the tubular part 102 and their electrodes 121 to 124. These floating capacitance and floating inductance form part of an electrical circuit. By the acceleration cavity being supplied with a radio frequency power, an accelerating electric field is excited. When exciting an electromagnetic field of the TE210 mode or TE211 mode suitable for radio frequency quadrupole accelerator, the potentials of the first electrode 121, second electrode 122, third electrode 123, and fourth electrode 124 become the same. Further, the electrode pair of the mutually facing first electrode 121 and second electrode 122 and the electrode pair of the mutually facing third electrode 123 and fourth electrode 124 become opposite polarities (plus or minus). The acceleration beam axis is arranged in the space between the four electrodes 121 to 124. The charged particles move while being accelerated along the acceleration beam axis.

Figure 13:
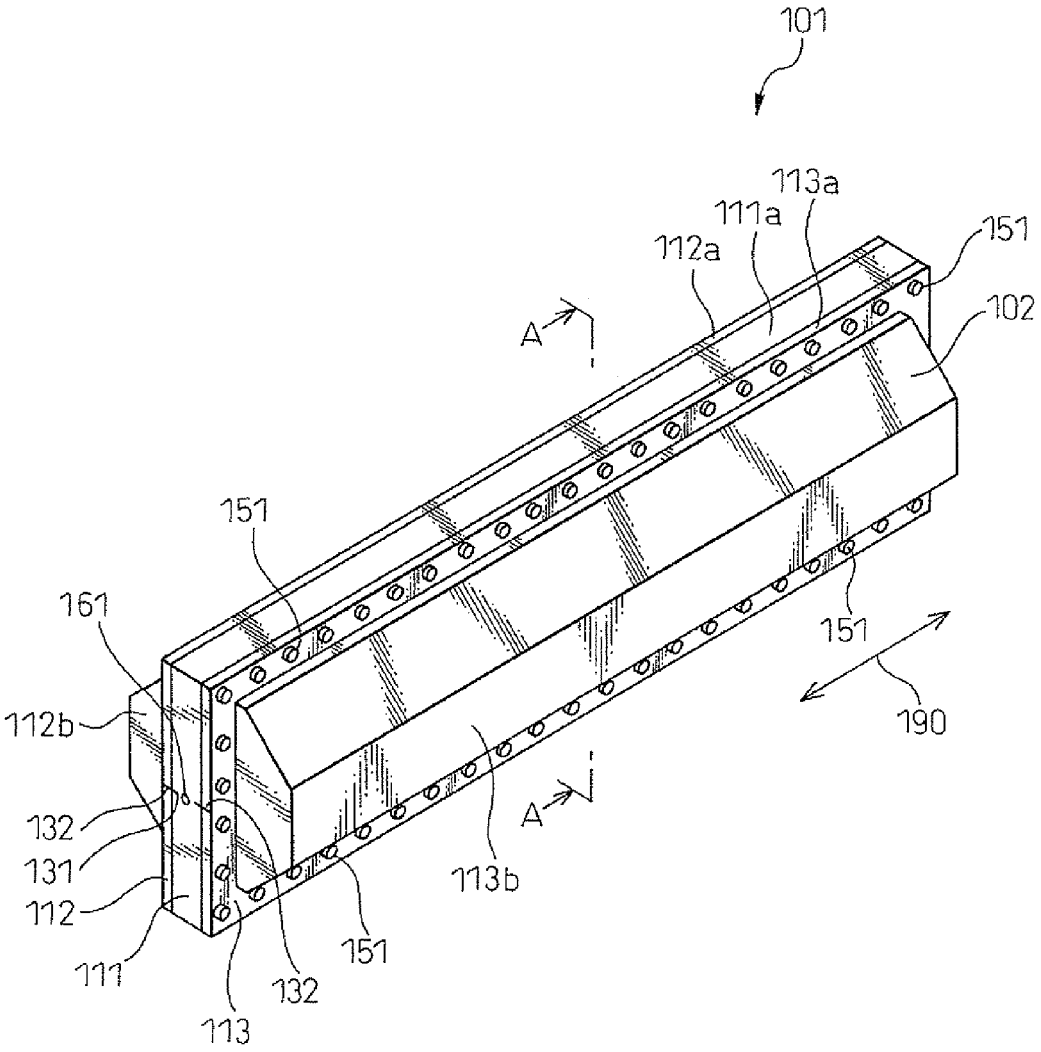
FIG. 13 is a schematic perspective view of an acceleration cavity of a radio frequency quadrupole accelerator in Embodiment 2.
Figure 14:
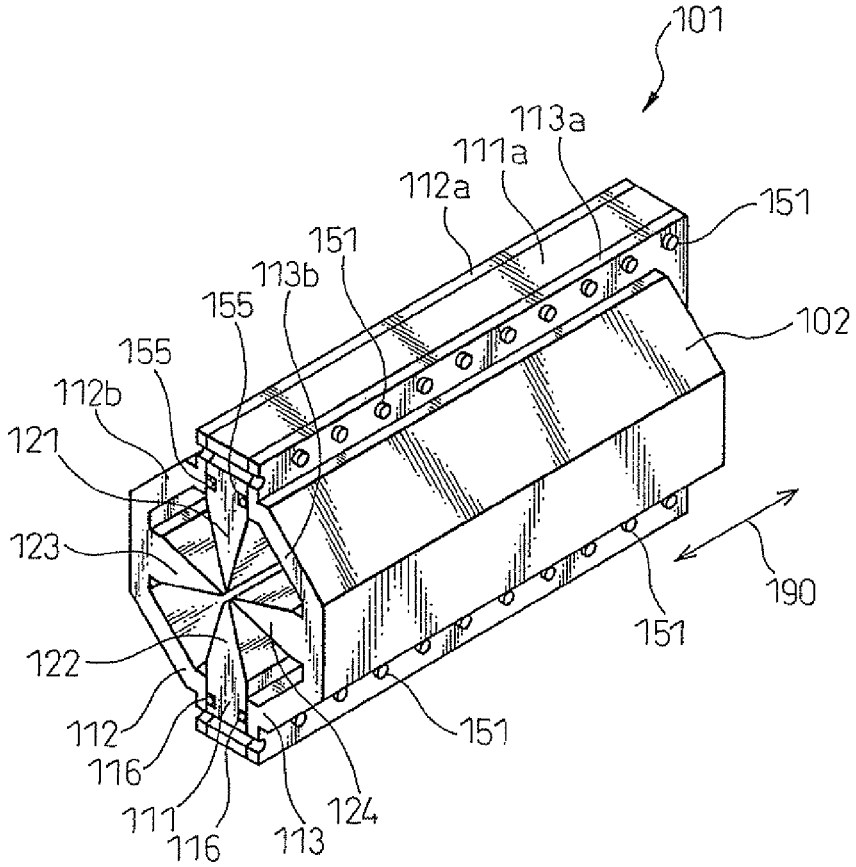
FIG. 14 is a schematic perspective view showing cut away the acceleration cavity of the radio frequency quadrupole accelerator in Embodiment 2.

FIG. 13 is a schematic perspective view of an acceleration cavity in the present embodiment. FIG. 14 is a schematic perspective view when cutting the acceleration cavity in the present embodiment. FIG. 14 is a perspective view of the time when cutting the acceleration cavity along the line A-A in FIG. 13. The arrow mark 190 indicates the direction of extension of the acceleration beam axis of the charged particles. The acceleration cavity 101 in the present embodiment is formed so as to extend in parallel with the direction of the acceleration beam axis.

Referring to FIG. 12 to FIG. 14, the acceleration cavity 101 in the present embodiment is provided with three component members. The acceleration cavity 101 is provided with a center member 111 which includes a first electrode 121 and a second electrode 122. The acceleration cavity 101 is provided with a first side member 112 which includes a third electrode 123. The acceleration cavity 101 is provided with a second side member 113 which includes a fourth electrode 124. The first side member 112 is arranged at one side of the center member 111. The second side member 113 is arranged at the other side of the center member 111. The center member 111, first side member 112, and second side member 113 in the present embodiment are respectively seamlessly formed from single members. That is, the center member and side members are formed from single materials without partitioning lines, weld lines, etc. of a plurality of parts. Note that, a vacuum port or other additional members may also be arranged in advance at the center member or side member.

The center member 111, first side member 112, and second side member 113 are fastened together by fastening members. In the present embodiment, as the fastening members, bolts 151 and nuts 152 are used for fastening.

At the contact surfaces between the center member 111 and the first side member 112 and the contact surfaces between the center member 111 and the second side member 113, O-rings 155 are arranged as vacuum sealing members. By these vacuum sealing members being arranged between the component members, the acceleration cavity 101 is sealed.

Figure 15:
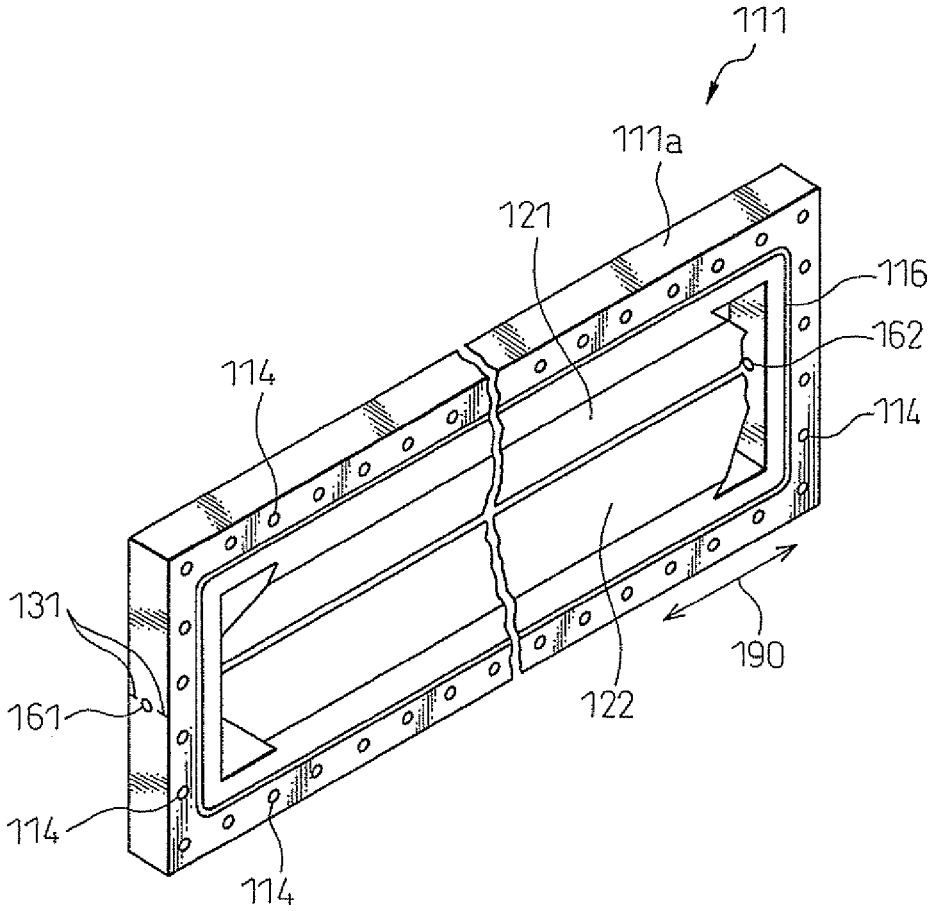
FIG. 15 is a schematic perspective view of a center member in Embodiment 2.

FIG. 15 is a schematic perspective view of the center member in the present embodiment. The center member 111 has a center outer frame part 111*a* which forms the center part of the outer frame part of the acceleration cavity 101. The center outer frame part 111*a* is formed in a window shape when viewed by a plan view. The center member 111 has a first electrode 121 which sticks out from the center outer frame part 111*a* toward the inside. The center member 111 includes a second electrode 122 which sticks out from the center outer frame part 111*a* toward the inside. The first electrode 121 and the second electrode 122 are arranged so that the tips face the acceleration beam axis.

In the surface at the outside of the center member 111, the end face in the direction of the acceleration beam axis is formed with a beam injection port 161 into which the charged particles enter. Further, the end face at the opposite side to the end face where the beam injection port 161 is formed is formed with a beam extraction port 162 from which the charged particles are extracted. The beam injection port 161 and the beam extraction port 162 are formed on an extension of the acceleration beam axis.

The center outer frame part 111*a* is formed with through holes 114 for passing bolts. Pluralities of through holes 114 are formed along the shape of the center outer frame part 111*a*. In the surface of the center outer frame part 111*a*, the contact surface which contacts the first side member 112 or second side member 113 is formed with a grooved part 116 for placement of an O-ring 155. The grooved part 116 is formed in a closed shape when viewed by a plan view. A grooved part for placement of an O-ring or other vacuum sealing member may also be arranged at the first side member 112 and second side member 113.

The center member 111 in the present embodiment is formed with reference marks 131 for determining the positions of the members with each other in the assembly step of assembling the members. In the present embodiment, the end face where the beam injection port 161 is formed is formed with a reference mark 131. Further, the end face where the beam extraction port 162 is formed is formed with a reference mark 131. The reference marks 131 in the present embodiment are formed in straight shapes.

Figure 16:
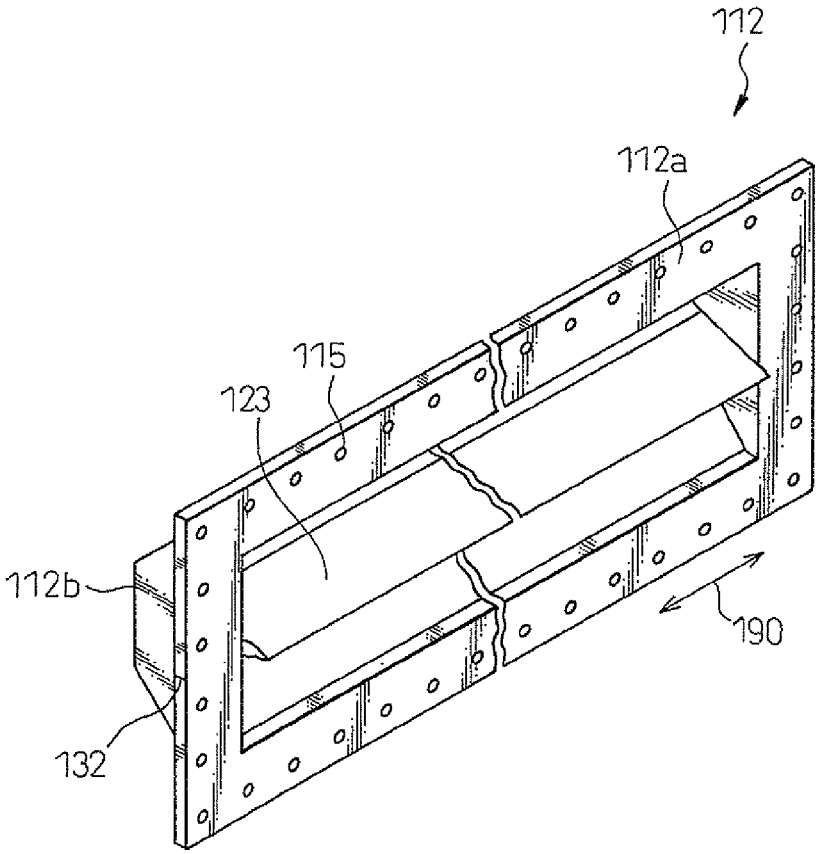
FIG. 16 is a schematic perspective view of a first side member in Embodiment 2.

FIG. 16 is a schematic perspective view of a side member in the present embodiment. The first side member 112 has a first side outer frame part 112*a* which forms a side part of the outer frame part of the acceleration cavity 101. The first side outer frame part 112*a* is formed into a window shape when viewed by a plan view. The first side member 112 has a first wall part 112*b* which has the shape of part of the acceleration cavity. The first wall part 112*b* forms the tubular part 102 of the acceleration cavity 101. The first wall part 112*b* is formed so that the first side outer frame part 112*a* extends toward the outside. The first wall part 112*b* is formed into a plate shape and is joined with the first side outer frame part 112*a*. The first side member 112 includes a third electrode 123 which sticks out from the first wall part 112*b* toward the inside.

The first side outer frame part 112*a* is formed with through holes 115 for passing bolts. The first side outer frame part 112*a* is formed with positioning marks 132 for determining the assembly position in the assembly step. In the present embodiment, at the end faces of the first side outer frame part 112*a*, the positioning marks 132 are formed at the end faces at the both sides in the direction of the acceleration beam axis.

In FIG. 16, the first side member 112 among the two side members is taken up as an example for the explanation, but the second side member 113 has a similar configuration to the first side member 112. The second side member 113 includes a window-shaped second side outer frame part 113*a*. The second side member 113 includes a second wall part 113*b* which extends from the second side outer frame part 113*a* toward the outside and has the shape of part of the acceleration cavity. The second side member 113 includes a fourth electrode 124 which sticks out from the second wall part 113*b* toward the inside.

Referring to FIG. 12 to FIG. 14, the acceleration cavity 101 is formed by the center outer frame part 111*a* and the first side outer frame part 112*a* in close contact with each other. Further, the center outer frame part 111*a* and the second side outer frame part 113*a* are in close contact. The center outer frame part 111*a* and the side outer frame parts 112*a* and 113*a* are fastened with each other by bolts 151 and nuts 152. Due to the center outer frame part 111*a* and side outer frame parts 112*a* and 113*a*, the outer frame part of the acceleration cavity 101 are formed.

Next, a method of production of a radio frequency quadrupole accelerator in the present embodiment will be explained. First, the center member 111, first side member 112, and second side member 113 in the present embodiment are formed. These component members are prepared in a member preparation step. The member preparation step in present embodiment includes a step of forming the center member 111, first side member 112, and second side member 113 seamlessly from single members.

In the present embodiment, an aluminum block is mechanically machined so as to form the component members. At the step of forming the component members, it is preferable to machine them out by a high precision. Further, in the process of production, a 3D measuring device etc. is preferably used to confirm the dimensions of the center member and the side members. Further, at the contact surfaces of the center outer frame part and the contact surfaces of the side outer frame parts, to secure electrical contact, the surface roughness is preferably made small. Furthermore, the inside surface of the tubular part and the surfaces of the electrodes are preferably worked to a high precision processing or ground etc. so as to reduce the surface roughness.

In the member preparation step, the center outer frame part 111*a* of the center member 111 is formed with the reference marks 131. Further, the first side outer frame part 112*a* of the first side member 112 is formed with positioning marks 132. The second side outer frame part 113*a* of the second side member 113 is formed with positioning marks 132. At the grooved part 116 which is formed at the center member 111, an O-ring 155 is placed as a vacuum sealing member.

Next, the center member 111, first side member 112, and second side member 113 are fastened together by bolts and nuts in the assembly step. The first side member 112 and the second side member 113 are placed at the both sides of the center member 111. In the present embodiment, the reference marks 131 which are formed at the center outer frame part 111*a* and the positioning marks 132 which are formed at the side outer frame parts 112*a* and 113*a* are aligned by positioning.

After the positioning, the bolts are fastened to join the center outer frame part 111*a* with the first side outer frame part 112*a* and second side outer frame part 113*a*. The center member 111, the first side member 112 and the second side member 113 are thereby fastened to each other. When using bolts etc. as the fastening members, it is preferable to tighten them while controlling the torque. This method enables the contact surfaces of the component members to be brought into contact with uniform pressure. The acceleration cavity can be formed in this way. By connecting a power supply device, vacuum device, etc. to this acceleration cavity, an accelerator can be produced.

The reference marks and positioning marks used for aligning are not limited to straight line shapes. Marks of any shapes can be employed. Further, the reference marks and positioning marks in the present embodiment are formed at the end faces in the direction of the acceleration beam axis among the outer surfaces of the acceleration cavity, but the invention is not limited to this. Reference marks and positioning marks may be formed at any positions of the outer surfaces of the acceleration cavity. For example, at the outer surfaces of the outer frame part of the acceleration cavity, the end faces in the direction vertical to the acceleration beam axis may be formed with the reference marks and positioning marks.

Referring to FIG. 12, in the first radio frequency accelerator in the present embodiment, when exciting an electromagnetic field of the TE210 mode or TE211 mode suitable for a radio frequency quadrupole accelerator, the magnitudes of the potential of the electrodes at any time are equal. The polarities are the same at mutually facing electrodes. The polarities of the potentials of mutually facing electrode in one direction are opposite to the polarities of the potentials of the mutual facing electrodes in a direction perpendicular to that one direction. By using the power supply device to supply radio frequency power, the potentials of the electrodes change along with time corresponding to a sine wave. For example, when, at one point of time, the potentials of the first electrode 121 and the second electrode 122 are the maximum value (positive value with maximum magnitude), the potentials of the third electrode 123 and the fourth electrode 124 become the minimum value (negative value with maximum magnitude). After the elapse of the half period of the resonance frequency, the potentials of the electrodes become the reverse relationship.

Radio frequency current flows through inside surface of the tubular part of the acceleration cavity 101 due to the skin effect. For this reason, the current, as shown by the arrow 194, flows along the surfaces of the electrodes 121 to 124 and the inner surface of the tubular part 102. The surfaces of the electrodes 121 to 124 and the inner surface of the tubular part 102 in the present embodiment are free of weld marks and other surface asperity, so the power loss can be reduced. As a result, the quality factor of the accelerator can be raised.

Further, in the present embodiment, the center member and the two side members are formed in advance and these component members are fastened with each other by fastening members. For this reason, in the assembly step, it is possible to avoid a rise in temperature of the component members. For example, in the assembly step, it is possible to avoid the component members from being heated overall in the case of using brazing for joining them and possible to suppress heat deformation of the component members. Heat deformation includes deformation due to internal stress being released when releasing the fastening of the tubular part by the fastening devices for a temporary assembly. In the present embodiment, it is possible to suppress deformation of the acceleration cavity, so it is possible to suppress deviation of the resonance frequency due to deformation. It is therefore possible to manufacture an accelerator precisely with respect to the design values.

In this way, the radio frequency quadrupole accelerator in the present embodiment is high in quality factor, small in deviation of the resonance frequency, and otherwise excellent in electrical performance.

Further, the radio frequency quadrupole accelerator in the present embodiment does not have joints of component parts joined by welding etc., so it is not necessary to perform the mechanical finishing work after welding a plurality of component members and therefore possible to easily manufacture the accelerator. For example, when using electron beam welding to weld component members, the surface roughness was large, so further grinding work and polishing work were necessary. The radio frequency quadrupole accelerator of the present embodiment enables manufacture of an acceleration cavity with a small surface roughness at the inside surface even without such finishing work.

Further, the radio frequency quadrupole accelerator in the present embodiment enables confirmation of the state of assembly in the middle of the assembly step. For example, by using a predetermined measuring device, it is possible to find out problems in the middle of the assembly step and correct the work etc. As a result, it is possible to improve the yield. Furthermore, it is possible to easily disassemble the accelerator after assembly in accordance with need by detaching the fastening members. For example, it is possible to readjust the positioning. Alternatively, it is possible to easily change the vacuum sealing members when replacing them.

In the present embodiment, the member preparation step includes a step of forming the reference marks 131 at the end faces of the center member 111 and positioning marks 132 at the end faces of the first side member 112 and the end faces of the second side member 113. The assembly step includes a step for positioning by alignment of the reference marks 131 and the positioning marks 132. By employing this method, the center member 111 and the side members 112 and 113 can be positioned easily.

The method of positioning in the assembly step is not limited to this. Any method may be employed. For example, a laser tracker can be used for positioning. In this case, for example, at the outer surfaces of the center outer frame part 111*a* and side outer frame parts 112*a*, 113*a*, the outer surfaces which extend in the direction parallel to the acceleration beam axis are formed with a high precision. These outer surfaces can be used as reference surfaces where the reflectors are placed.

Alternatively, it is possible to form in advance engagement parts which have mutually engaging shapes at the center member and side members and mate these engagement parts so as to perform positioning. In the member preparation step, the center member is formed with a first engagement part and the first side member and second side member are formed with second engagement parts. In the assembly step, the first engagement part and the second engagement parts are made to engage with each other, whereby the members can be positioned with each other. This method enables easy positioning.

For example, in the member preparation step, the center member and the side members are made able to be positioned by forming projecting parts as first engagement parts at the center member and forming grooved parts as second engagement parts at the side members. In the assembly step, the projecting parts and grooved parts may be made to engage to easily position the center member and side members.

Alternatively, it is possible to form in advance positioning holes which are communicated when the center member and the side members are positioned right and to insert pins into the positioning holes to enable positioning. In the member preparation step, the center member is formed with first positioning holes, while the first side member and second side member are formed with second positioning holes. In the assembly step, by inserting positioning pins into the first positioning holes and second positioning holes, the members can be positioned with each other. This method enables easy positioned.

For example, in the member preparation step, the center member and side members are formed with positioning holes between the through holes for the bolts used as the fastening members. The positioning holes are formed so that when assembled into the acceleration cavity, the positioning holes of the center member and the positioning holes of the side members are communicated with each other. The positioning holes are preferably formed at a plurality of locations. In the assembly step, pins which can closely fit into the positioning holes are inserted into the positioning holes of the center member and the positioning holes of the side members, whereby the center member and side members can be easily positioned.

In the present embodiment, bolts which pass through the center member, first side member, and second side member are used to fasten these component members, but the invention is not limited to this. Any fastening members can be used to fasten the center member and the side members. For example, the center member may be formed with threaded through holes or blind holes. By inserting bolts from the outsides of the through holes of the first side member, the first side member can be fastened to the center member. Further, by inserting bolts from the outsides of the through holes of the second side member, the second side member can be fastened to the center member. In this way, the side members may be individually fastened to the center member. Due to this method, it is possible to position the members with each other and fasten the members with each other more easily.

In the method of production in the present embodiment, it is possible to easily manufacture a radio frequency quadrupole accelerator with a long axial direction length along the acceleration beam axis. For example, when using brazing to manufacture a radio frequency quadrupole accelerator with a long axial direction length, it is necessary to place the acceleration cavity inside a high temperature furnace. For this reason, a large size, high temperature furnace becomes necessary. However, in the present embodiment, the center member and side members are formed seamlessly to enable easy manufacture of an accelerator which is long in the direction of the acceleration beam axis.

Further, in the present embodiment, the member forming the tubular part of the acceleration cavity and the electrodes are formed seamlessly. In the method of production of the acceleration cavity, it may be considered to manufacture the tubular part and the electrodes separately, then use bolts etc. to fasten the electrodes to the tubular part. However, with this method, the number of parts become greater and positioning of the component members with each other becomes difficult. As opposed to this, like in the present embodiment, if employing component members comprised of electrodes and members forming the tubular part formed seamlessly, easy positioning becomes possible. Further, the positional relationship of the tubular part and the electrodes is high in dimensional precision since the precision at the time of machining is maintained. A radio frequency quadrupole accelerator which is excellent in electrical performance can be provided.

The radio frequency quadrupole accelerator in the present embodiment can interpose conductive members in the region where the center member 111 and the first side member 112 contact and in the region where the center member 111 and the second side member 113 contact. For example, instead of rubber O-rings used as vacuum sealing members, metal sealing members may be placed. Alternatively, in addition to the grooved parts for placement of the vacuum sealing members, it is also possible to additionally form grooved parts at least at one contact surface among the center member and side members and place metal wires or other conductive members at the grooved parts.

By fastening the center member 111 and the side members 112 and 113 through the conductive members, the conduction between the center member 111 and the side members 112 and 113 can be improved. Alternatively, the desired electrical performance can be secured.

Further, a radio frequency quadrupole accelerator rises in temperature due to electrical resistance due to operation. If the temperature greatly rises, the O-rings are liable to damage. In such a case, it is possible to employ metal sealing members so as to avoid damage of the sealing members. For example, metal vacuum sealing members are suitable for a radio frequency quadrupole accelerator which is continuously operated. Further, a radio frequency accelerator may be provided with a cooling device for cooling the acceleration cavity. For example, cooling tubes for flowing cooling water may be arranged at the insides of the electrodes or at the surfaces of the side members.

The radio frequency quadrupole accelerator in the present embodiment is formed so that the cross-sectional shape of the tubular part becomes a regular octagon, but the invention is not limited to this. It is possible to employ any shape by which suitable electrical performance as a radio frequency quadrupole accelerator can be realized. For example, the tubular part can be formed to become a circular or another polygonal cross-sectional shape.

Further, in the present embodiment, the center member and side members are formed from aluminum, but the invention is not limited to this. The center member and side members may be formed from any material. For example, in the member preparation step, the component members may be formed from a block of copper. Alternatively, it is possible to employ component members formed by any materials and then plated with copper on their surfaces.

The above embodiments may be suitably combined.

In the above figures, the same or corresponding parts are assigned the same reference notations. Note that, the above embodiments are illustrations and do not limit the invention. Further, in the embodiment, changes included in the claims are also intended.

REFERENCE SIGNS LIST

1 tubular part
11 first component member
12 second component member
13 third component member
14 fourth component member
21 support member
31 reinforcing member
51 butt line
52 joint
72 radio frequency generator
101 acceleration cavity
102 tubular part
111 center member
111*a* center outer frame part
112, 113 side member
112*a*, 113*a* side outer frame part
112*b*, 113*b* wall part
121 to 124 electrode
131 reference mark
132 positioning mark

The invention claimed is:

1. A method of production of a radio frequency accelerator which has a tubular part which forms an acceleration cavity and which has electrodes arranged inside of the tubular part, the method of production of a radio frequency accelerator including a preparation step of preparing a plurality of component members which have shapes obtained by splitting the tubular part, a temporary assembly step of making the plurality of component members mate with each other to temporarily assemble them into the shape of the tubular part, a step of fastening a temporarily assembled tubular part by pressing it from the outer side, and a welding step of welding the plurality of component members together, wherein the temporary assembly step includes a step of placing, inside of the tubular part, support members for contacting the inside surface of the tubular part and supporting the tubular part from the inside, and the welding step includes a step of welding the plurality of component members along the butt lines by friction stir welding.

2. A method of production of a radio frequency accelerator as set forth in claim 1, wherein the plurality of component members are formed with cutaway parts at regions for friction stir welding, and the method includes a step of attaching reinforcing members which have shapes which engage with the cutaway parts after the welding step.

3. A method of production of an accelerator as set forth in claim 1, wherein the method of production is for an accelerator which is provided with four electrodes which stick out from the tubular part toward the acceleration beam axis of the charged particles, the plurality of component members have shapes obtained by splitting the tubular part near the bottom parts of the electrodes, and the temporary assembly step includes a step of arranging support members which contact butt lines of the plurality of component members and extend along the acceleration beam axis.

4. A method of production of a radio frequency accelerator as set forth in claim 1, wherein the preparation step prepares component members comprised of members which form the tubular part and electrodes which are formed seamlessly.

5. A radio frequency accelerator provided with a tubular part which forms an acceleration cavity and which includes a plurality of component members, wherein at least one component member among the plurality of component members includes an electrode, the plurality of component members are welded with each other through joints which are formed by friction stir welding, and the joints are formed with stripe-shaped weld mark at outer surfaces, and a surface roughness of the inner surfaces is smaller than a surface roughness at the outer surfaces.

6. A radio frequency accelerator as set forth in claim 5, wherein, the tubular part has cutaway parts which are formed at regions of the joints of the friction stir welding, and the radio frequency accelerator is further provided with reinforcing members which are engaged with the cutaway parts to be fastened to the component members.

7. A radio frequency quadrupole accelerator provided with a center member which includes a center outer frame part, a first electrode which sticks out from the center outer frame part toward the inside, and a second electrode which sticks out from the center outer frame part toward the inside, a first side member which includes a first side outer frame part, a first wall part which extends from the first side outer frame part toward the outside and which has the shape of part of an acceleration cavity, and a third electrode which sticks out from the first wall part toward the inside and which is arranged at one side of the center member, and a second side member which includes a second side outer frame part, a second wall part which extends from the second side outer frame part toward the outside and which has the shape of part of an acceleration cavity, and a fourth electrode which sticks out from the second wall part toward the inside and which is arranged at the other side of the center member, wherein the center member, the first side member, and the second side member are respectively formed seamlessly from single members, and the center member, the first side member, and the second side member are configured so that the center outer frame part, the first side outer frame part, and the second side outer frame part are fastened by fastening members.

8. A radio frequency quadrupole accelerator as set forth in claim 7, wherein the center member, the first side member, and the second side member are fastened with each other through conductive members.

9. A method of production of a radio frequency quadrupole accelerator including a member preparation step which prepares a center member which includes a center outer frame part, a first electrode which sticks out from the center outer frame part and a second electrode which sticks out from the center outer frame part, a first side member which includes a first side outer frame part, a first wall part which has the shape of part of an acceleration cavity, and a third electrode which sticks out from the first wall part, and a second side member which includes a second side outer frame part, a second wall part which has the shape of part of an acceleration cavity, and a fourth electrode which sticks out from the second wall part, and an assembly step of arranging the first side member and the second side member at the both sides of the center member and fastening the center outer frame part, first side outer frame part, and second side outer frame part with each other by fastening members, wherein the member preparation step includes a step of respectively forming the center member, first side member, and second side member seamlessly from single members.

10. A method of production of a radio frequency quadrupole accelerator as set forth in claim 9, wherein the member preparation step includes a step of forming reference marks at an outer surface of the center member and a step of forming positioning marks at the outer surface of the first side member and the outer surface of the second side member, and the assembly step includes a step of aligning the reference marks and the positioning marks to position the members with each other.

11. A method of production of a radio frequency quadrupole accelerator as set forth in claim 9, wherein the member preparation step includes a step of forming first engagement parts at the center member and a step of forming second engagement parts at the first side member and the second side member, and the assembly step includes a step of making the first engagement parts and the second engagement parts engage with each other so as to position the members with each other.

12. A method of production of a radio frequency quadrupole accelerator as set forth in claim 9, wherein the member preparation step includes a step of forming first positioning holes at the center member and a step of forming second positioning holes at the first side member and the second side member, and the assembly step includes a step of inserting positioning pins in the first positioning holes and the second positioning holes so as to position the members with each other.

* * * * *